US009970186B2

(12) United States Patent
Hodkiewicz

(10) Patent No.: US 9,970,186 B2
(45) Date of Patent: May 15, 2018

(54) PLUNGER WITH DISPOSABLE COVER

(75) Inventor: Scot Hodkiewicz, Lake Geneva, WI (US)

(73) Assignee: Scot Hodkiewicz, Lake Geneva, WI (US)

( * ) Notice: Subject to any disclaimer, the term of this patent is extended or adjusted under 35 U.S.C. 154(b) by 700 days.

(21) Appl. No.: 12/196,680

(22) Filed: Aug. 22, 2008

(65) Prior Publication Data

US 2009/0049593 A1 Feb. 26, 2009

Related U.S. Application Data

(60) Provisional application No. 60/957,802, filed on Aug. 24, 2007.

(51) Int. Cl.
*E03D 9/00* (2006.01)
*E03D 9/10* (2006.01)

(52) U.S. Cl.
CPC ..... *E03D 9/10* (2013.01)

(58) Field of Classification Search
USPC ..... 4/255.01, 255.11, 255.12
See application file for complete search history.

(56) References Cited

U.S. PATENT DOCUMENTS 4,922,555 A * 5/1990 Bonilla et al. ..... 4/255.11
6,701,540 B1 * 3/2004 Gabriel ..... 4/255.11
7,124,450 B2 * 10/2006 Davidson ..... 4/255.11
7,281,278 B1 * 10/2007 Biagi et al. ..... 4/255.11

* cited by examiner

*Primary Examiner* — Brian E Glessner
*Assistant Examiner* — Gisele Ford

(57) ABSTRACT

Disclosed is a plunger including, in combination, a handle, a plunger bell with an inner bell surface, and an elongated tubular sheath, wherein the sheath at least substantially encases the handle and plunger bell, and the sheath is at least partially secured to the inner bell surface.

12 Claims, 3 Drawing Sheets

PLUNGER WITH DISPOSABLE COVER

CROSS-REFERENCE TO RELATED APPLICATIONS

Priority is hereby claimed to provisional application Ser. No. 60/957,802, filed Aug. 24, 2007, which is incorporated herein

FIELD OF THE INVENTION

The invention is directed to a device for clearing clogged plumbing. More specifically, the invention is drawn to a plunger with a replaceable, disposable, sanitary cover.

BACKGROUND OF THE INVENTION

Plungers have been used since time immemorial to unclog jammed plumbing, such as sinks and toilets. It is inevitable that every plunger put into use will eventually come into contact with human waste. After a conventional plunger has been used to free a clog in a toilet, the user is faced with the unappealing task of cleaning the plunger of residual matter and returning the plunger to wherever it is stored when not in use. This clean up problem has bedeviled the users of plungers for as long as plungers have been in existence. Additionally, the design of a plunger head requires that it perform like a bellows in order to function properly. Thus, plunger heads in general have a tendency trap matter therein, and make effectively cleaning the plunger very difficult. This difficulty is exacerbated by natural human aversion to having human excrement contacting human hands.

SUMMARY

The invention is directed to a plunger construction comprising: a handle, a plunger bell with an inner bell surface, and an elongated tubular sheath. The sheath at least substantially encases the handle and plunger bell, and the sheath is at least partially secured to the inner bell surface.

The sheath may be comprised of any suitable flexible material, such as a thermosetting or thermoplastic polymer film.

The plunger construction may optionally further comprise holding tabs on the sheath that secure a portion of the sheath to the handle. It is preferred that the sheath is at least partially secured to the inner bell surface. This can be done by any suitable fastener, such as a peel and stick-type adhesive, contact cement, hook and loop fasteners, etc.

In one embodiment of the invention, the handle is comprised of a fixed handle portion and a slidable handle portion. The fixed handle portion has one end attached to the plunger bell and the other end slidably engaged to the slidable handle portion. The slidable handle portion is configured to collapse upon the fixed handle portion in a collapsed position and extend from the fixed handle portion in an extended position. It is preferred that the fixed handle portion and the slidable handle portion are hollow and form a handle cavity and the slidable handle portion is slidably engaged to the fixed handle portion by an airtight seal. In this version of the invention there is an opening defined in the inner bell surface leading to the handle cavity, and the handle is configured so that extending the slidable handle portion creates a vacuum at the opening in the inner bell surface which secures the sheath against the inner bell surface. The plunger may further comprise a one-way air valve contained in the slidable handle portion. The one-way air valve is configured to allow the handle to collapse in the collapsed position when the plunger bell is covered by the sheath. The plunger may include a lock configured to secure the slidable handle portion in the extended position, such as a pop-up latch mounted on the fixed portion that engages a corresponding hole in the slidable handle portion or twist-and-lock handle.

In another version of the invention, the fixed handle portion and the slidable handle portion are hollow and form a handle cavity. An opening is defined in the inner bell surface leading to the handle cavity. An attaching device is disposed within the handle cavity and has a first end connected to the slidable handle portion and a second end extending through the opening in the inner bell surface and secured to the sheath. In this fashion, the sheath is removably fixed to the plunger.

The plunger may also comprise a spring-pressurized piston that is configured to spring upwards to secure the sheath against the inner bell surface.

DETAILED DESCRIPTION

The present invention is directed to a plunger with a replaceable cover 24 that allows the user to clean the plunger quickly and easily. The device is dimensioned and configured substantially to encase the plunger, as well as the user's hands, thereby preventing the plunger and user from directly contacting any matter in a clogged sink, toilet bowl, or other plumbing fixture. Once the job is complete, the encasement that surrounds the plunger and the user's hands is easily removed and discarded.

Figure 1:
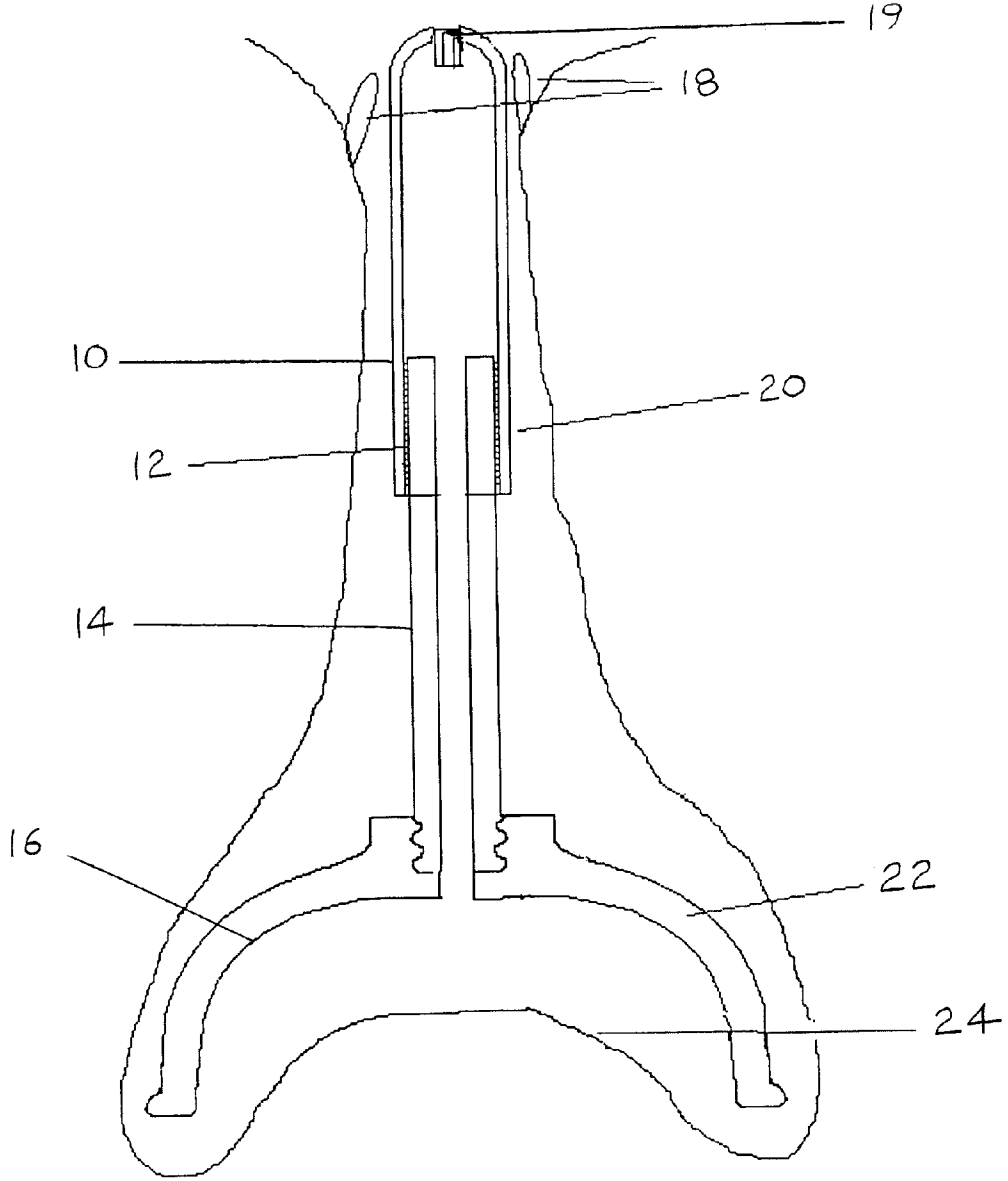
FIG. 1 shows a cross-sectional view of a slidable plunger handle that utilizes vacuum pressure as a securing means, a standard bell shaped plunger bell, and a protective sheath.

One version of the invention is depicted in FIG. 1. FIG. 1 shows a cross-sectional view of the plunger encased in a replaceable cover or encasement 24. As depicted in FIG. 1, the plunger according to the present invention has a resilient, flexible bell 22 at the bottom, attached to a collapsible handle 20. The handle 20 comprises two parts; a fixed handle portion 14 having one end attached to the bell 22, and the other end 10 being slidably engaged with the fixed handle portion 14. The sliding handle portion 10 is generally hollow and connected to the fixed handle portion 14 in such a manner that it may be extended upward away from the bell, to a stop point, and then locked in place by twisting. In short, the sliding handle portion 10 and the fixed handle portion 14 are dimensioned and configured to slidingly engage, relative to each other, and are extendible from a first collapsed position to a second extended position, as shown in FIG. 1. The handle portions are sealed where they slidingly engage to provide an air-tight seal 12 around the circumference of the fixed portion of the handle, thereby creating a vacuum at the opening 17 to the fixed handle portion 14 that engages the bell 22. Thus, as shown in FIG. 1, the sliding handle portion 10 may include an air valve 19 to allow the handle to collapse even when the bell end is covered by the sheath 24.

An elongated sheath 24 made of any suitably flexible material, preferably a thermosetting or thermoplastic polymer film, most preferably a polyethylene film, is placed over the plunger bell 22 and handle 20. The sheath 24 is closed on the bell end to receive the plunger bell 22, and open on the other end to allow access to the handle 20 by the user. The handle end of the sheath has a pair of holding tabs 18 extending inside the sheath. These tabs may be used to secure a portion of the sheath 24 to the handle 20 after the sheath has been pulled over the plunger and the user's hands.

The bell end of the sheath is designed to have a portion that may be pulled into the plunger bell. This portion may be secured by utilizing the handle 20 to create a vacuum in the bell 22, thereby pulling the sheath 24 up against the inner bell surface 16. By locking the slidable handle portion 10 in the extended position the vacuum pressure may be maintained, thereby securing the sheath 24 until the handle 20 is unlocked and released. Once the plunger is no longer needed, the slidable portion 10 of the handle is unlocked and slid towards the bell 22, thereby releasing the vacuum that was securing the sheath 24 against the inner bell surface 16 and placing the handle in the collapsed position. The sheath 24 is then folded upon itself down the handle 20 and over the plunger bell 22, thereby inverting the sheath 24 and allowing the user to avoid contact with the outer surface of the sheath 24 that was exposed to the toilet water.

Figure 2:
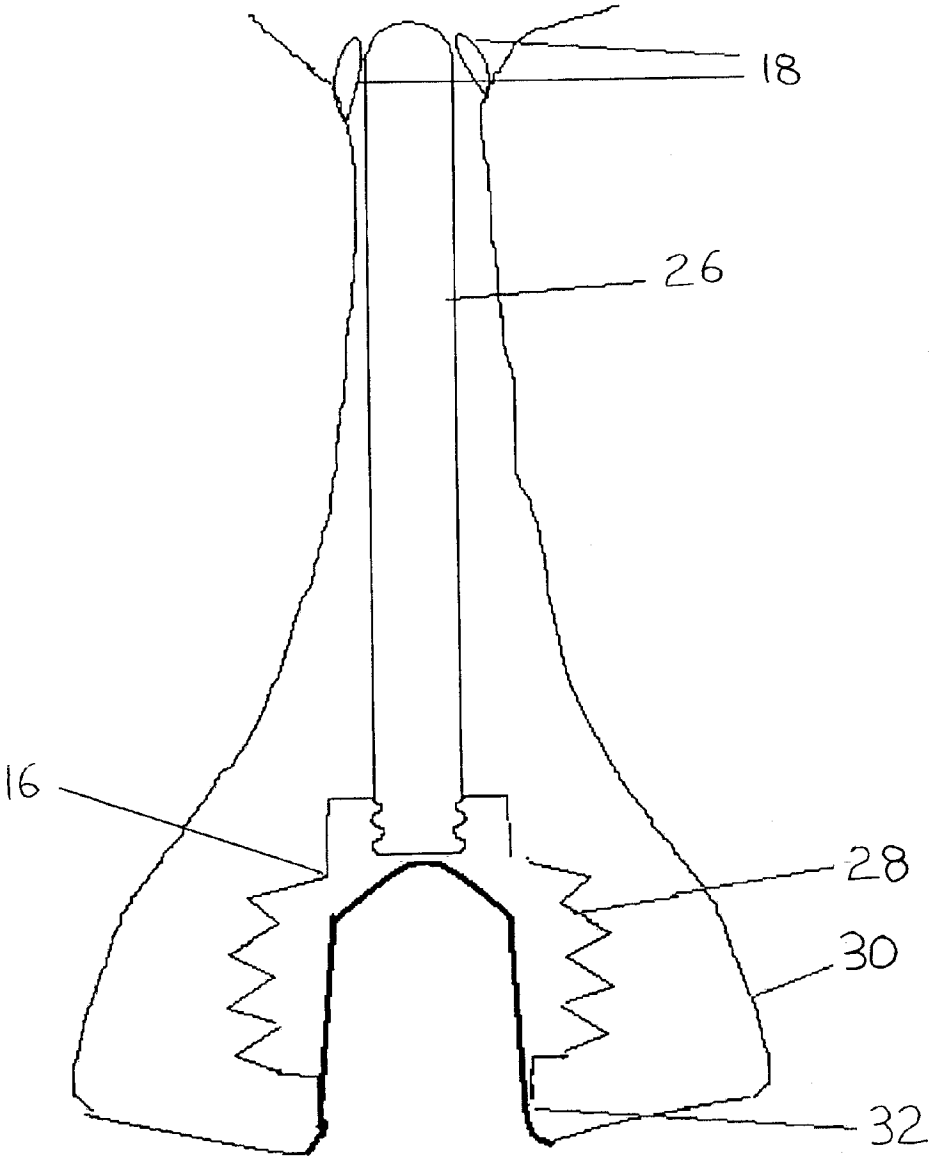
FIG. 2 shows a cross-sectional view of a fixed plunger handle utilizing adhesive as a securing means, a bellows-type plunger bell, and a protective sheath.

Another version of the invention is depicted in FIG. 2. FIG. 2 depicts a cross-sectional view of a plunger encased in a replaceable cover 30. The plunger construction is comprised of a solid handle 26 with a bellows-type plunger bell 28 and an elongated sheath 27. The sheath 27 has an open end for inserting the plunger and a closed end to cover the bell 28. The sheath 27 is preferably an elongated piece of flexible material (as noted earlier) that tapers out as the open end approaches the closed end, with an adhesive portion 32 inside the closed end for adhering the sheath 27 to the inner bell surface 16. The sheath 27 is placed over the plunger bell 28 with the adhesive portion exposed (for example, removing the paper from a peel-and-stick-type adhesive). The adhesive portion is affixed to the inner bell surface 16 and the sheath 27 is extended over the handle 27. Once the plunger cover 30 is no longer needed, the sheath is then folded upon itself down the handle and over the plunger bell 28, thereby inverting the sheath 27 and allowing the user to avoid contact with the outer surface of the sheath that was exposed to the toilet water. The sheath may then be discarded, leaving a clean plunger.

The aforementioned embodiments are merely a few versions of the invention, and it is contemplated that numerous additions and modifications can be made. The following are additional examples. It is understood that these examples are not to be construed as describing the only additions and modifications to the invention and that the true scope of the invention is defined by the claims included herein.

Figure 3:
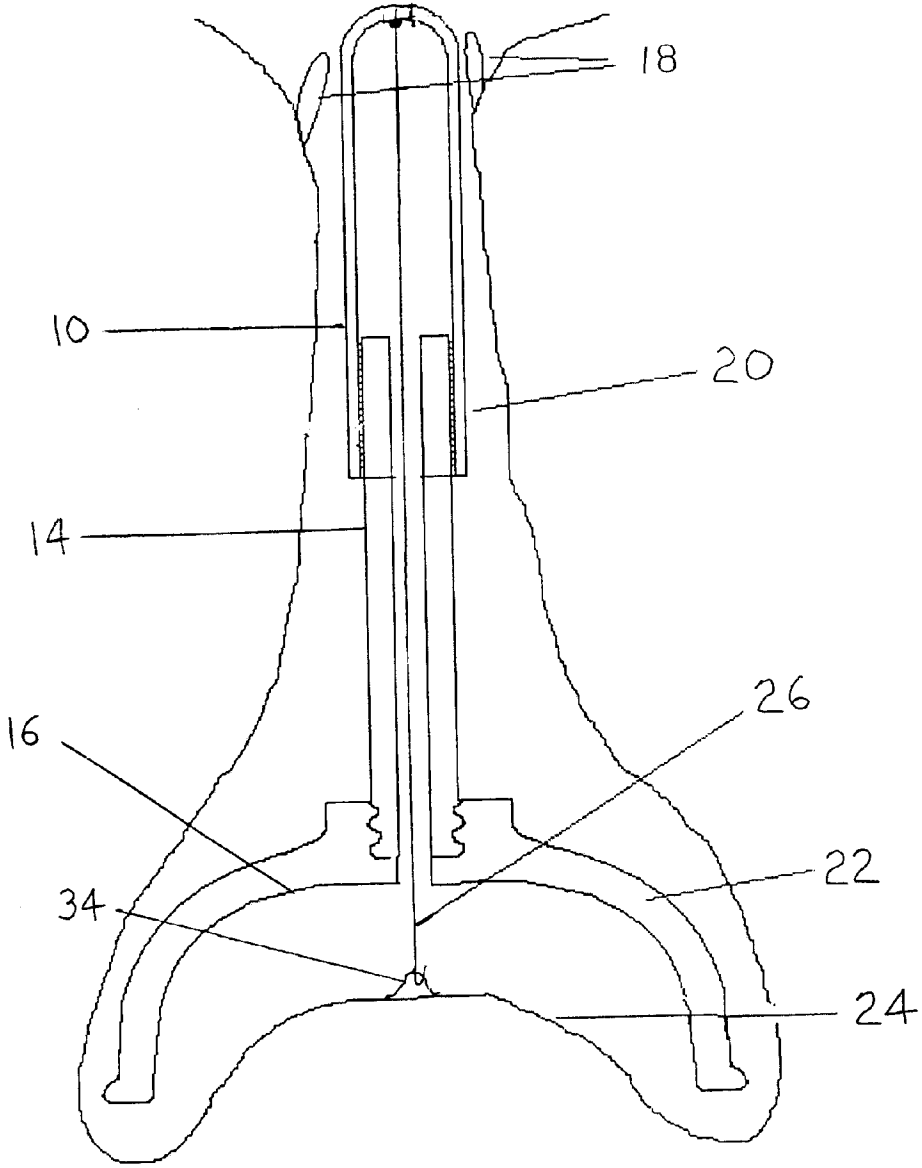
FIG. 3 shows a cross-sectional view of a slidable plunger handle that utilizes a hook mechanism as a securing means, a standard bell-shaped plunger bell, and a protective sheath with a loop.

There are several methods contemplated for securing the sheath to the inner bell surface. One such method contemplated is illustrated in FIG. 3. Here, a hook 26 may extend down the slidable handle assembly 20, wherein when the slidable handle 10 is depressed, the hook exits the handle into the bell area. The flexible sheath cover includes a loop 34 for attaching to the hook. Once the sheath loop 34 has been hooked, the handle 20 is slid upwards, thereby pulling the hook 26 back into the handle 20 and thereby securing the sheath 24 by pulling it tight against the inner bell surface 16. Other means of controlling the hook assembly have been contemplated, for example, a spring-urged piston extending downwards with a hook on the end that may be pushed further inside the handle cavity to latch the sheath loop 34 and then allowed to spring upwards to pull the hook 26 and loop 34 connection tight. Further, the sliding handle portion preferably locks into a fixed position with the fixed handle portion 14 by twisting, although, several other methods may be used; for example, a pop-up latch mounted on the fixed portion that snaps into a hole in the slidable portion thereby locking it.

In the fixed handle configuration, several means of securing the sheath to the inner bell surface are contemplated. The use of a peel-and-stick-type adhesive 32 is preferred, although various other securing means would be acceptable, for example a hook-and-loop fastener configuration, or contact cement.

The sheath material may be polyethylene, but may also be made of various other plastic polymers or composites. The sheath may be elastic or non-elastic and of single or varying thicknesses and size. The sheath may have a circular, square or another shape cross-sectional configuration. The sheath preferably tapers out moving from the handle end towards the bell end, but may have a continuous diameter as well. Additionally, it is contemplated that one or more sheaths may be stored inside the plunger handle or bell for easy access and convenient storage. The stored sheaths may further be attached in a continuous manner to allow for sequential dispersion from the handle. The plunger bell for any embodiment may be of various shapes and sizes and may attach to the handle by various means such as the male and female threaded connection typically found in plungers.

What is claimed is:

1. A plunger construction comprising: a handle, a plunger bell with an inner bell surface, and an elongated tubular sheath, wherein the sheath at least substantially encases the handle and plunger bell, and the sheath is at least partially secured to the inner bell surface; wherein the handle is comprised of a fixed handle portion and a slidable handle portion, with the fixed handle portion having one end attached to the plunger bell and the other end slidably engaged to the slidable handle portion, wherein the slidable handle portion is configured to collapse upon the fixed handle portion in a collapsed position and extend from the fixed handle portion in an extended position; and wherein the fixed handle portion and the slidable handle portion are hollow and form a handle cavity and the slidable handle portion is slidably engaged to the fixed handle portion by an airtight seal, further comprising an opening in the inner bell surface leading to the handle cavity, and wherein the handle is configured so that extending the slidable handle portion creates a vacuum at the opening in the inner bell surface, thereby securing the sheath against the inner bell surface.

2. The plunger construction of claim 1, wherein the sheath is comprised of a thermosetting or thermoplastic polymer film.

3. The plunger construction of claim 1, further comprising holding tabs on the sheath that secure a portion of the sheath to the handle.

4. The plunger construction of claim 1, wherein the sheath is at least partially secured to the inner bell surface by peel and stick-type adhesive or contact cement.

5. The plunger construction of claim 1, further comprising a one-way air valve contained in the slidable handle portion, wherein the one-way air valve is configured to allow the handle to collapse in the collapsed position when the plunger bell is covered by the sheath.

6. The plunger construction of claim 1, further comprising a lock configured to secure the slidable handle portion in the extended position.

7. The plunger construction of claim 6, wherein the lock comprises a pop-up latch mounted on the fixed portion that engages a corresponding hole in the slidable handle portion or twist-and-lock handle.

8. The plunger construction of claim 1, wherein the fixed handle portion and the slidable handle portion are hollow and form a handle cavity, further comprising an opening in the inner bell surface leading to the handle cavity, and further comprising an attaching device disposed within the handle cavity and having a first end connected to the slidable handle portion and a second end extending through the opening in the inner bell surface and secured to the sheath.

9. The plunger construction of claim 8, further comprising a lock configured to secure the slidable handle portion in the extended position.

10. The plunger construction of claim 9 wherein the lock comprises a pop-up latch mounted on the fixed portion that engages a corresponding hole in the slidable handle portion or a twist-and-lock handle.

11. The plunger construction of claim 8, wherein the attaching device comprises an extended locking hook, and further comprising a loop fixed to the sheath, wherein the extended locking hook removably attaches to the loop.

12. The plunger construction of claim 8, further comprising a spring-pressurized piston that is configured to spring upwards to secure the sheath against the inner bell surface.

* * * * *